United States Patent [19]

Kerttula

[11] 4,311,550

[45] Jan. 19, 1982

[54] CONTINUOUSLY OPERATING BOARD PRESS

[75] Inventor: Into Kerttula, Solymar Benalmadena Costa, Spain

[73] Assignee: Bison-Werke Bahre & Greten GmbH & Co. KG, Fed. Rep. of Germany

[21] Appl. No.: 187,143

[22] Filed: Sep. 15, 1980

[51] Int. Cl.[3] ..... B30B 5/06; B30B 15/34

[52] U.S. Cl. ..... 156/555; 100/93 RP; 100/154; 156/583.5; 425/371

[58] Field of Search ..... 156/555, 580, 583.5, 156/583.91, 380; 100/151, 154, 93 RP; 425/371

[56] References Cited

U.S. PATENT DOCUMENTS

| | | | |
|---|---|---|---|
| 1,729,125 | 9/1929 | Reece | 156/555 |
| 3,340,795 | 9/1967 | Hartley | 156/580 |
| 3,688,688 | 9/1972 | Kerttula et al. | 100/154 |
| 3,981,666 | 9/1976 | Wadman | 425/371 |
| 4,193,342 | 3/1980 | Held | 156/555 |
| 4,253,391 | 3/1981 | Held | 156/555 |

*Primary Examiner*—Michael G. Wityshyn
*Attorney, Agent, or Firm*—Craig and Antonelli

[57] ABSTRACT

A continuously operating board press in which board material to be pressed is guided between two continuously circulating endless belts in such a way that at least the upper press belt runs through a pressure chamber, whereby a pressure arrangement exerts a pressure loading on the belt and the board material. Walls that laterally define the pressure chamber are elastic and on lower edges of the walls a weight plate is fastened. The weight plate is flexible at least in a longitudinal direction of the press. The plate, because of its intrinsic weight, is constantly applied to the upper press belt. The weight plate is provided with one or more conduits for enabling an admission of a pressure medium into a gap between the weight plate and the press belt. The gap is closed off by means of at least longitudinal seals.

27 Claims, 3 Drawing Figures

CONTINUOUSLY OPERATING BOARD PRESS

The present invention relates to a continuously operating board press in which the board material to be pressed is guided between two continuously circulating press belts of infinite length, in such a way that at least the upper press belt runs via a pressure chamber whereby pressure means exert a pressure loading on the belt and on the board material.

The term board press here means a press that can be utilized for the pressing of board, such for example as plywood, chip or fiber board or the like, and also for the lamination of boards of different kinds, for provision of a surface layer on all kinds of boards, etc. In all these cases the boards must be put under pressure. The boards may be available in the form of a long web or of shorter pieces that are introduced in succession into the press.

In order that the treatment of the boards that are to be produced or processed may go on concurrently, there has been an effort for a long time to go over from batch presses to continuously operating presses. Such a continuously operating press is described in U.S. Pat. No. 3,688,688. The known press functions satisfactorily if boards are to be pressed that have no great degree of compression, i.e. in which the initial thickness does not much exceed the thickness of the finished board. Such boards for example are plywood boards. If on the contrary chip or fiber boards are pressed, the thickness of the mat introduced into the machine is substantially greater than the thickness of the finished board issuing from the machine. In this case the compression of the chip mat has offered difficulties. In fact, the difficulties in compression have blocked use of a continuously operating press.

The present invention is intended to develop a continuously operating board press that may be utilized likewise for the pressing of materials that have to be compressed to nominal thickness at the beginning. The invention is characterized in that the walls that laterally define the pressure chamber are elastic, and in that on their lower edges a weighting plate is fixed that is at least flexible in the longitudinal direction of the press, which plate because of its intrinsic weight is always applied to the upper press belt, and in that the weighting plate is provided with one or more conduits for admission of a pressure medium into the gap between the weighting plate and the press belt, and in that the said gap is closed off by means of at least longitudinal seals.

The weighting plate adapts itself to the behavior of the board material. If the board material that is to be processed is of such a kind that it is more or less pressed together in the initial phase of the pressing operation, the weighting plate always of itself assumes the form and position that corresponds to the compression. On the other hand, boards of different thickness can be pressed without any adjustment because the weighting plate automatically is adapted to any thicknesses. One is thus freed of all adjustments.

One and the same pressure acts on both sides of the weighting plate. Consequently the friction between the seals and the press belt is evoked only by the intrinsic weight of the weighting plate. Thus the friction is not great. On the other hand, the friction is independent of the pressure that prevails in the pressure chamber, and of the pressing program, as well as of the thickness of the material that is to be pressed.

The press according to the invention must not be constructed in two parts (a compression part, and a part with uniform thickness), but it has an unvaried structure over its entire length. Depending upon the nature of the board material that is to be pressed, the compression area may be shorter or longer. The press according to the invention is adapted to all tasks, independently of the length of the compression area.

In the board press according to the invention, the weighting plate may be flexible in the crosswise direction also. This is necessary in those cases, however rare, in which the thickness of the board material varies transversally. Because the weighting plate is flexible, there is also the effect that the friction between the seals and the press belt is unvaried in all situations, and that it is possible to get along with quite simple seals.

In the press according to the invention, the walls that laterally define the pressure chamber are elastic. It is clear that they allow movement of the weighting plate in the vertical direction.

A favorable embodiment of the invention is characterized in that the weighting plate is of rubber, e.g. hard rubber, or plastic. Such a weighting plate adapts itself both longitudinally and crosswise to the forms of the boards in the pressing process. A metallic fabric or even chainlike members may be embedded in the weighting plate as reinforcement, allowing flexibility of the weighting plate. The weighting plate must have such weight that it will press adequately against the seals. Naturally the weighting plate can be constructed of only chain lamellae or metallic fabric.

A second favorable form of embodiment of the invention is characterized in that the seals are fastened to the under surface of the weighting plate. On the other hand, one might imagine a solution of the problem in which the longitudinally running seals would be seated on the press belt, in a situation in which there are no transverse seals.

As a rule the plates are pressed according to a pressure curve that rises by steps at the start, from zero to a maximum and then back to zero. Such a pressure characteristic is readily produced according to the invention. The pressure chamber can be divided into successive part chambers in which different pressures prevail. In order that the pressure change at the partitions between the part chambers not be excessively abrupt, there may be provision of transverse seals below the weighting plate at the places where the partitions are between the part chambers, said transverse seals having an extent in the longitudinal direction of the press that is substantially greater than the partition thickness. Such seals balance the pressure change.

In pressing board, heat is often used to set the binder. According to the invention, heat can be delivered to board material in the molding process, in that the pressure medium is heated, or for example by incorporation of electrical resistors in the weighting plate.

In the press according to the invention, friction strives to urge the weighting plate in the direction toward the downstream end of the press. To prevent this, the weighting plate is connected with the starting end of the press frame by one or more horizontal articulated arms. The arms allow vertical movements of the weighting plate.

Figure 2:
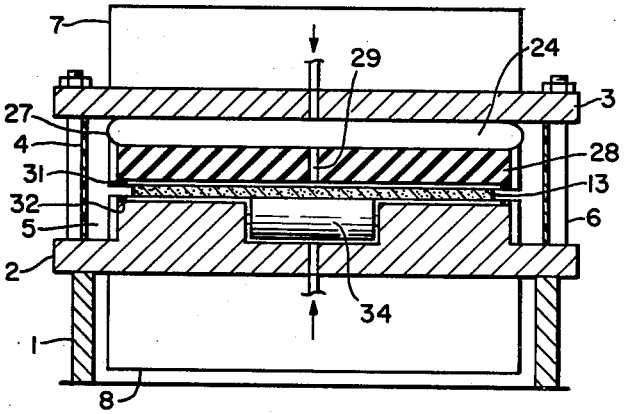
FIG. 2 is a cross sectional view taken along line II—II of FIG. 1.

In the drawing, reference numeral 1 refers to the frame on which the press rests. The under part 2 and the upper part 3 of the frame are tensioned with reference to each other by uprights 6. Between lower part 2 and upper part 3 there are protective transparent plates 4, e.g. of bulletproof glass, on both sides of the press and along its entire length. The primary purpose of these plates is to prevent the spraying around of pressure medium in case of leakage. The pressure medium may be a liquid, oil for example, or it may be a gas, e.g. air. In case a liquid is used as pressure medium and there is leakage, the liquid is collected in chamber 5 (FIG. 2) from which it is suctioned back into the pressure system. There are no leakage losses.

Figure 1:
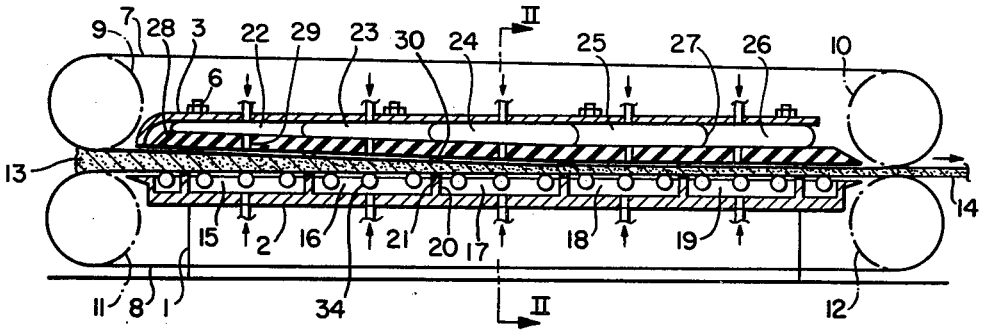
FIG. 1 is a partially schematic longitudinal cross sectional view of a continuously operating board press in accordance with the present invention.

The press comprises two endless press belts 7 and 8 which between them define the pressing gap. The belts may be of steel, for example. Belt 7 runs over end rolls 9 and 10 whereas belt 8 runs over end rolls 11 and 12. Rolls 10 and 12 to the right in FIG. 1 are drawing rolls. The drive machinery is left out of the figure for the sake of clarity. The board material to be pressed, in the illustrated case, comprises chip mat 13 which is introduced into the gap between press belts 7 and 8, whence it issues as finished chip board 14.

The lower press belt 8 and therewith also chip mat 13 is upwardly loaded by means of a pressure chamber, whereby the said pressure chamber is subdivided into five successive compartments 15, 16, 17, 18, 19. The pressure is lowest in compartments 15 and 19 and maximal in compartment 17. On the upper surfaces of partitions 20 between the compartments, transverse seals 21 are fastened. The seals may, for example, be a Teflon strip.

The upper press belt 7 and therewith also the chip mat is acted on by pressure in a downward direction by means of a pressure chamber, whereby the pressure chamber, like that on the under side, comprises five compartments 22, 23, 24, 25, 26. Compartments 22–26 are disposed at the same places as compartments 15–19 on the underside, and the same pressure prevails in the compartments 15–19 as in the compartments 22–26. The walls may consist of a plastic sheet of for example, Teflon or a rubberlike material. Walls 27 are seated with their upper edges tightly on upper part 3 of the frame. Weighting plate 28 in turn is fixed tightly to the lower edges of walls 27. The weighting plate consists of a flexible material such as hard rubber or the like. A conduit 29 leads from each compartment 22–26 down in below the weighting plate, so that the pressure on both sides of the weighting plate 28 is of the same magnitude. With each wall 27, there is a transverse seal 30 below weighting plate 28. Besides, there are lontidutinally running seals 31 on the edges of weighting plate 28. In the same way, under part 2 of the frame has corresponding longitudinal seals 32.

In operation of the board press according to the invention, press belts 7 and 8 pull the material 13 that is to be pressed through the press. Since the pressure in compartments 15–19 and correspondingly in compartments 22–26 is the same, the friction between seals 30 and press belt 7, as well as between seals 21 and press belt 8 is very slight. Only the weight of weighting plate 28 has an effect on the first mentioned friction. As to the latter friction, the weight of the press belts and of the intermediately disposed material has an influence.

Figure 3:
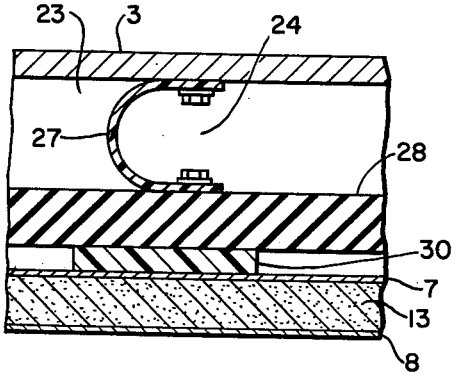
FIG. 3 is an enlarged detailed cross sectional view of a portion of a longitudinally running vertical section of the continuously operating press of the present invention.

As shown in FIG. 3, the seal 30 is relatively wide. Consequently the pressure difference that exists in this case between compartments 23 and 24 does not act abruptly on the material to be pressed, and in fact it is much more uniform.

Press belt 7 strives to urge weighting plate 28 by friction toward the downstream end of the press. To prevent this, weighting plate 28 can be connected with the starting end of the upper part 3 of the frame, by articulated arms. Weighting plate 28 can thereby move freely in the vertical direction.

As shown in FIG. 1, in the lower part 2 of the frame 1 there are freely rotatable rolls 34. They are intended to support the pack produced by the belts 7 and 8 and the material 13 therebetween, so that it will not sag in the middle.

It is instructive to the specialist that various forms of embodiment of the invention may vary. In operation with, for example, compressed fluid, two pairs of lateral seals can be provided, between which there is a collector conduit for leakage. With flow pressure there can be operation without transverse seals, whereby then the maximum pressure from middle compartment 24 passes through weighting plate 28 and flows off below it toward the two ends. For this purpose, compartments 22, 23, 24, 25 and 26 are closed toward the bottom. Care must also be taken to have the gap between the weighting plate 28 and the press belt increase at the ends, corresponding to the pressures of the respective compartments, whereby the same result is achieved without transverse seals. In the gap or flow space there can be provision of a pressure controlled fine regulation of the flow space.

Lower pressure chambers 15–19 are not essential from the point of view of the invention, because the lower half of the press merely serves as a support for the pressing pressure that comes from above. Therefore pressure chambers 15–19 can be replaced by some other kind of construction.

I claim:

1. A continuously operating board press comprising an upper and lower continuously circulating endless press belt means for guiding board material to be pressed through the press, and means for exerting a pressure load on at least the upper press belt means and the board material, characterized in that the pressure load means includes at least one pressure chamber means having spaced lateral walls of an elastic material, weight plate means secured to a lower edge of the lateral walls for constantly applying a pressure on the upper pressure belt means, a gap is provided between the weight plate means and the upper press belt means, means are provided in the weight plate means for enabling a supplying of a pressure medium into the gap, and in that means are provided for sealing the gap.

2. A board press according to claim 1, characterized in that the weight plate means is flexible at least in a longitudinal direction of the press.

3. A board press according to claim 2, characterized in that the sealing means includes seals extending in a longitudinal direction of the press.

4. A board press according to claim 3, characterized in that the weight plate means constantly applies the pressure on the upper press belt means because of the intrinsic weight of the weight plate means.

5. A board press according to one of claims 1, 2, 3 or 4, characterized in that the weight plate means is made of a flexible material.

6. A board press according to claim 5, characterized in that the flexible material is a hard rubber.

7. A board press according to claim 5, characterized in that the flexible material is a plastic material.

8. A board press according to claim 5, characterized in that means are provided in the weight plate means for reinforcing the same.

9. A board press according to claim 8, characterized in that the reinforcing means is a metallic fabric.

10. A board press according to claim 8, characterized in that the reinforcing means includes a plurality of chain like members.

11. A board press according to claim 5, characterized in that the sealing means are disposed on an under surface of the weight plate means.

12. A board press according to claim 11, characterized in that a plurality of pressure chamber means are provided, each of the pressure chamber means having different pressures prevailing therein, and in that a transversely extending sealing means is provided below the weight plate means in an area of each of the lateral walls defining partitions between the respective pressure chamber means.

13. A board press according to claim 12, characterized in that each of the transversely extending sealing means has a length in a longitudinal direction of the press which is greater than a thickness of the walls defining the partitions.

14. A board press according to claim 13, characterized in that means are provided for heating the weight plate means.

15. A board press according to claim 14, characterized in that said heating means includes a heater for heating the pressure medium.

16. A board press according to claim 14, characterized in that the heater means includes electric resistance means disposed in the weight plate means.

17. A board press according to claim 14, characterized in that at least one arm means is articulated to a portion of a frame of the press at an inlet end thereof for connecting the weight plate means to the frame.

18. A board press according to one of claims 1, 2, 3, or 4, characterized in that the weight plate means is formed of one of a chain lamellae or a metallic fabric.

19. A board press according to claim 18, characterized in that the chain lamellae or metallic fabric is embedded in one of a rubber or plastic material.

20. A board press according to one of claims 1, 2, 3 or 4, characterized in that a plurality of pressure chamber means are provided, each of the pressure chamber means having different pressures prevailing therein, and in that a transversely extending sealing means is provided below the weight plate means in an area of each of the lateral walls defining partitions between the respective pressure chamber means.

21. A board press according to one of the claims 1, 2, 3 or 4, characterized in that means are provided for heating the weight plate means.

22. A board press according to one of claims 1, 2, 3 or 4, characterized in that at least one arm means is articulated to a portion of a frame of the press at an inlet end thereof for connecting the weight plate means to the frame.

23. A board press according to one of the claims 1, 2, 3 or 4, characterized in that means are provided for supporting the lower press belt means.

24. A board press according to claim 23, characterized in that said supporting means includes at least one lower pressure chamber means for exerting a pressure load on the lower press belt means.

25. A board press according to claim 24, characterized in that a plurality of pressure chamber means are provided for exerting a pressure load on the upper press belt means, each of the last mentioned pressure chamber means having different pressures prevailing therein.

26. A board press according to claim 25, characterized in that a plurality of lower pressure chamber means are provided for exerting a pressure load on the lower press belt means.

27. A board press according to claim 26, characterized in that the supporting means further includes a plurality of rollers spaced in a longitudinal direction of the press for supporting the lower press belt means.

* * * * *

UNITED STATES PATENT AND TRADEMARK OFFICE

CERTIFICATE OF CORRECTION

PATENT NO. : 4,311,550

DATED : January 19, 1982

INVENTOR(S) : Into Kerttula

It is certified that error appears in the above-identified patent and that said Letters Patent is hereby corrected as shown below:

ON THE TITLE PAGE INSERT,

-- (30) Foreign Application Priority Data

Sept. 15, 1979 (DE) Fed. Rep. of Germany--2937410 --.

Signed and Sealed this

Seventh Day of December 1982

[SEAL]

*Attest:*

GERALD J. MOSSINGHOFF

*Attesting Officer* *Commissioner of Patents and Trademarks*